US008313335B2

(12) United States Patent
Wu

(10) Patent No.: US 8,313,335 B2
(45) Date of Patent: Nov. 20, 2012

(54) POWER ADAPTER ASSEMBLY WITH A ROTATION LOCKING COLLAR

(75) Inventor: Jui-Hsiung Wu, Taipei (TW)

(73) Assignees: Well Shin Technology Co., Ltd., Taipei (TW); Dongguan Well Shin Electronics Products Co., Ltd., Guangdong (CN)

( * ) Notice: Subject to any disclaimer, the term of this patent is extended or adjusted under 35 U.S.C. 154(b) by 212 days.

(21) Appl. No.: 12/972,860

(22) Filed: Dec. 20, 2010

(65) Prior Publication Data

US 2012/0156915 A1 Jun. 21, 2012

(51) Int. Cl.
*H01R 29/00* (2006.01)

(52) U.S. Cl. ..... 439/172; 439/518

(58) Field of Classification Search ..... 439/345, 439/170, 171, 172, 173, 518, 312
See application file for complete search history.

(56) References Cited

U.S. PATENT DOCUMENTS

| | | | | |
|---|---|---|---|---|
| 7,168,969 | B1 * | 1/2007 | Wang | 439/173 |
| 7,601,023 | B1 * | 10/2009 | Ma et al. | 439/518 |
| 7,632,137 | B1 * | 12/2009 | Ma et al. | 439/518 |
| 7,946,868 | B1 * | 5/2011 | Chen | 439/173 |
| 8,033,847 | B1 * | 10/2011 | Chen | 439/172 |
| 8,079,877 | B1 * | 12/2011 | Lai et al. | 439/655 |
| 8,226,424 | B1 * | 7/2012 | Wang et al. | 439/172 |
| 2003/0228778 | A1 * | 12/2003 | Shang | 439/172 |

* cited by examiner

*Primary Examiner* — Hae Moon Hyeon
(74) *Attorney, Agent, or Firm* — WPAT, P.C.; Anthony King

(57) ABSTRACT

The invention provides a power adapter assembly including an adapter body, a replaceable plug and a rotation locking collar. The adapter body comprises a cylindrical casing and a circular plug receiving base fixed on top of the cylindrical casing. The plug receiving base has a recess on the top thereof and a circular peripheral surface. The circular peripheral surface has a flange with an indentation on the top edge thereof, and a guiding groove formed from the indentation and extending downward to the bottom edge thereof. The replaceable plug is detachably mounted onto the plug receiving base. The rotation locking collar is detachably sleeved onto the plug receiving base and the support base, wherein the locking collar has a tab member on the inner top edge thereof adapted to enter the guiding groove and said one end of the elongated engagement groove.

4 Claims, 4 Drawing Sheets

POWER ADAPTER ASSEMBLY WITH A ROTATION LOCKING COLLAR

BACKGROUND OF THE INVENTION

1. Field of the Invention

The invention relates to a power adapter assembly which particularly avoids the accidental withdrawal of a plug from an adapter body, so as to prohibit the poor electrical connection.

2. Description of the Prior Art

The traditional rotation-operated power adapter assembly includes an adapter body and a plug. Generally, there are corresponding recess and protrusion structures designed on the adapter body and the plug. The plug can be fixed onto the adapter body by engagements of the recess and protrusion structures by rotation of the plug relative to the adapter body. Besides, it is allowable for users to replace a variety of plugs having different electricity standards according to practical requirements.

However, it is easy to loosen even separate this kind of power adapter assembly by an unexpected rotation of one of the assembly during the assembly or using situation, resulting in the poor electrical connection.

SUMMARY OF THE INVENTION

The main object of the invention is to provide a power adapter assembly which particularly avoids the accidental withdrawal of a plug from an adapter body, so as to prohibit the poor electrical connection.

According to a preferred embodiment of the invention, the power adapter assembly includes an adapter body, a replaceable plug and a rotation locking collar. The adapter body includes a cylindrical casing and a circular plug receiving base fixed on top of the cylindrical casing. The plug receiving base has a recess on the top thereof and a circular peripheral surface. The recess has an engagement block on the side wall thereof. The circular peripheral surface has a flange with an indentation on the top edge thereof, and a guiding groove formed from the indentation and extending downward to the bottom edge thereof.

The replaceable plug is detachably mounted onto the plug receiving base and includes a cylindrical support base comprising an upper portion and a lower portion sized to fit into the recess of the plug receiving base. The upper portion has an elongated engagement groove along its peripheral surface with one end extending to the bottom edge thereof and alignable with the guiding groove. The lower portion has an engagement groove adapted to engage with the engagement block in the recess of the plug receiving base.

The rotation locking collar is detachably sleeved onto the plug receiving base and the support base, wherein the locking collar has a tab member on the inner top edge thereof adapted to enter the guiding groove and said one end of the elongated engagement groove. The tab member is further allowed to rotate into and engage with the elongated engagement groove by rotation of the locking collar, so as to lock the plug.

After the combination of the power adapter assembly, the first engagement block in the recess of the plug receiving base engages with the first engagement groove of the lower portion of the support base; the tab member is allowed to rotate into and engage with the elongated engagement groove of the upper portion of the support base. By this way, the plug is locked so as to prevent the withdrawal thereof from the adapter body.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
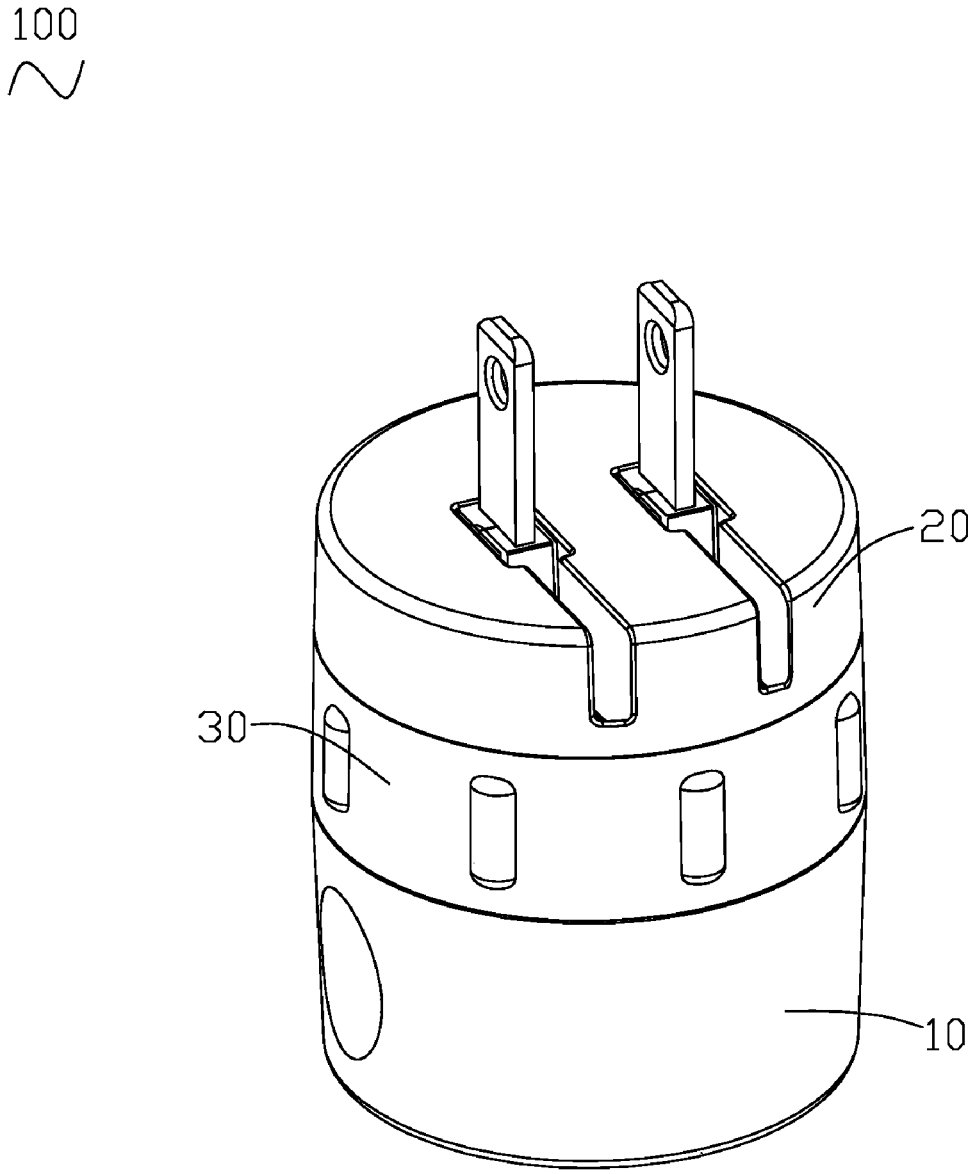
FIG. 1 is a perspective assembled view of the power adapter assembly of the present invention.

Please refer to FIG. 1. The power adapter assembly 100 includes an adapter body 10, a replaceable plug 20 and a rotation locking collar 30. In practical applications, the replaceable plug 20 may satisfy a variety of electricity standards.

Figure 2:
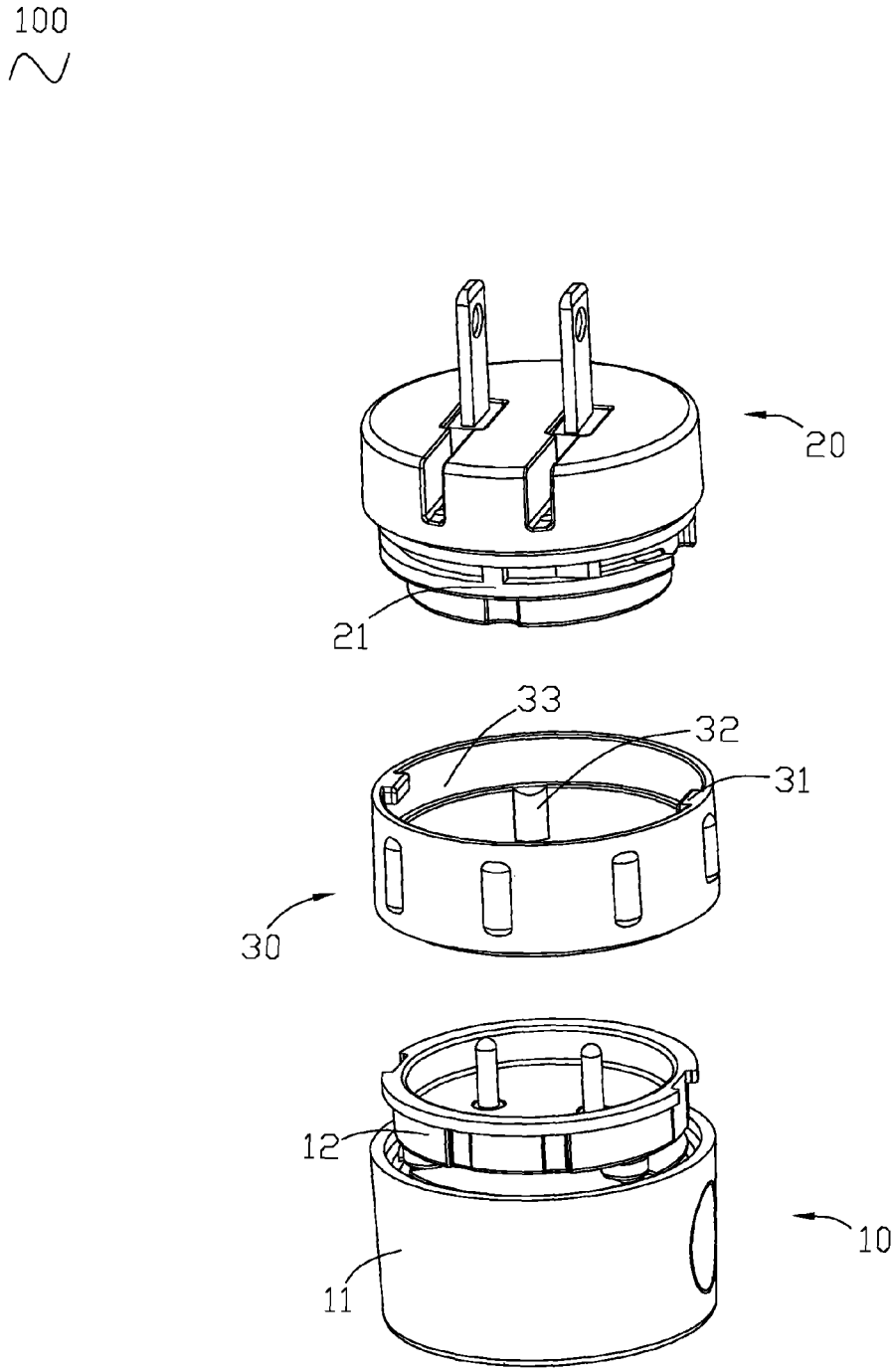
FIG. 2 is a perspective exploded view of the power adapter assembly.
Figure 3:
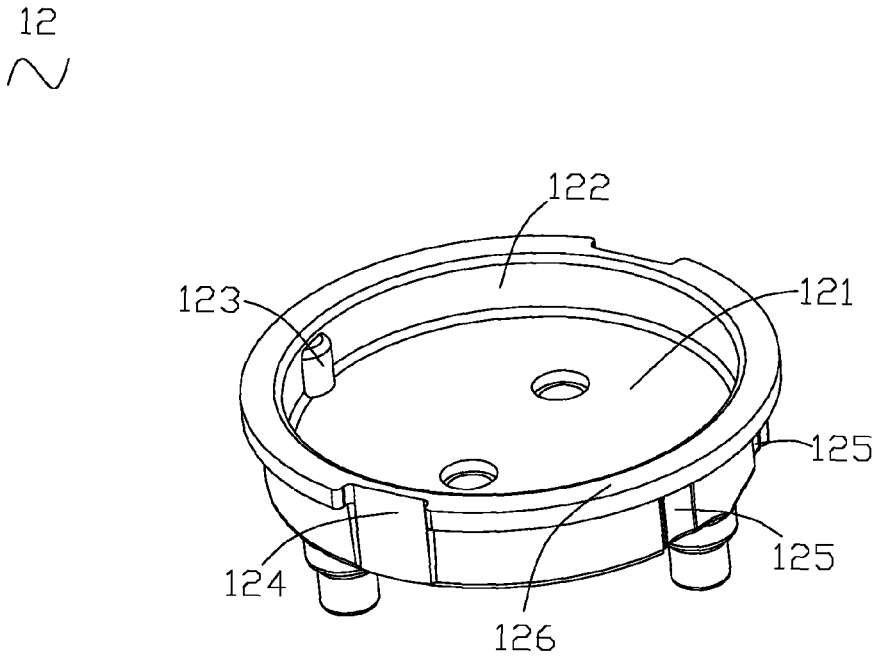
FIG. 3 is a perspective view of the plug receiving base of the adapter body.

Please refer to FIG. 2 and FIG. 3. The adapter body 10 includes a cylindrical casing 11 and a circular plug receiving base 12 fixed on top of the cylindrical casing 11. The plug receiving base 12 has a circular bottom 121 and a wall 122 projecting upward from the edge of the circular bottom 121. So, the plug receiving base 12 has a recess on the top thereof and a circular peripheral surface (i.e. the outer surface of the wall 122). Besides, the recess may have two engagement blocks 123 on the side wall thereof. In this embodiment, the circular peripheral surface has a flange 126 with two indentations on the top edge thereof and two guiding grooves 124. The two indentations may be formed opposite to each other at the edge of the flange 126. Each guiding groove 124 is formed from one indentation and extends downward to the bottom edge of the circular peripheral surface.

In one embodiment of the present invention, the circular peripheral surface of the plug receiving base 12 may have two engagement grooves 125 formed below the flange 126 and extending downward to the bottom edge thereof.

Figure 4:
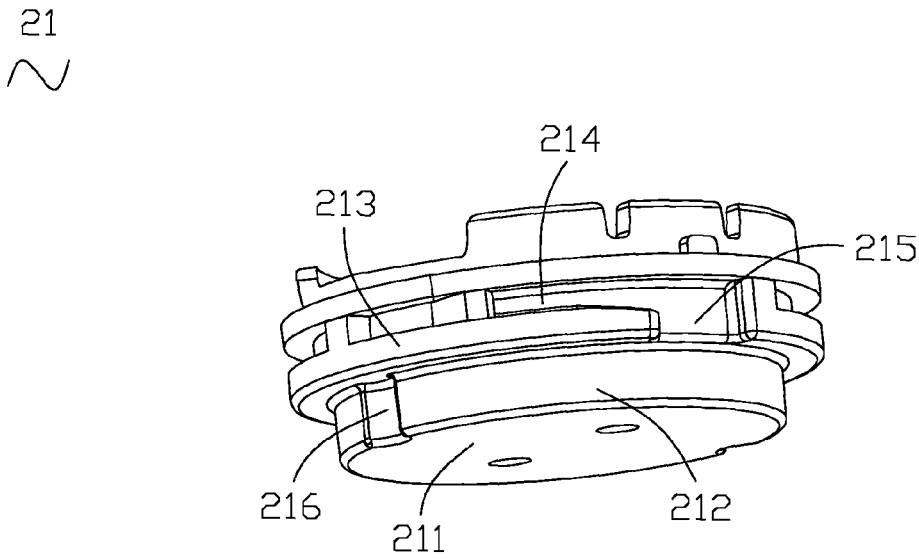
FIG. 4 is a perspective view of the support base of the plug.

Please refer to FIG. 2 and FIG. 4. The replaceable plug 20 is detachably mounted onto the plug receiving base 12 and includes a cylindrical support base 21 comprising an upper portion and a lower portion sized to fit into the recess of the plug receiving base 12. The lower portion has a circular bottom 211 and a wall 212 projecting upward from the edge of the circular bottom 211. In this embodiment, the upper portion may have two elongated engagement grooves 214 along its peripheral surface. Each elongated engagement groove 214 has one end extending to the bottom edge of the upper portion to form a groove inlet 215 which is alignable with one guiding groove 124 of the plug receiving base 12. Besides, the lower portion may have two engagement grooves 216 on its outer peripheral surface adapted to engage with the two engagement blocks 123 in the recess of the plug receiving base 12, respectively. In one embodiment of the present invention, the support base 21 has a circular step rib 213 projecting radially along the bottom edge of the upper portion except where the two groove inlets 215 are located.

Figure 5:
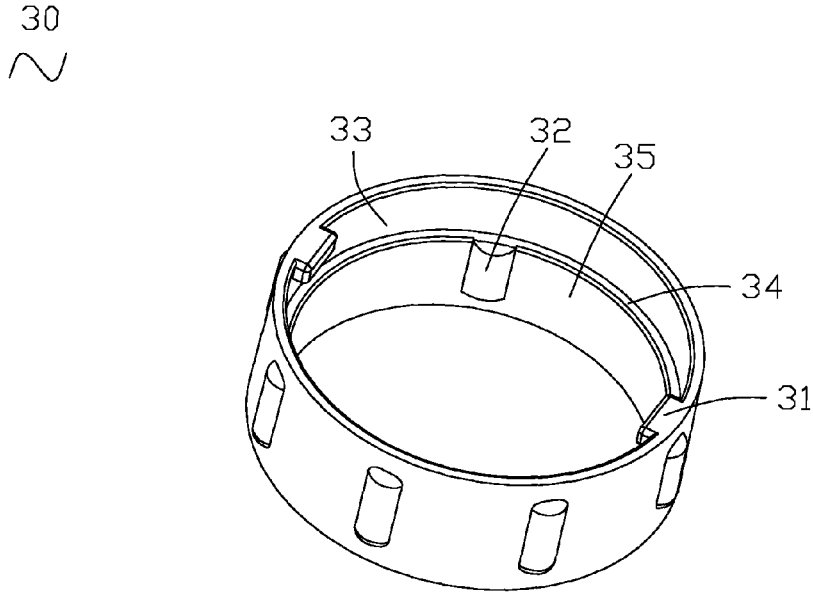
FIG. 5 is a perspective view of the rotation locking collar.
Figure 6:
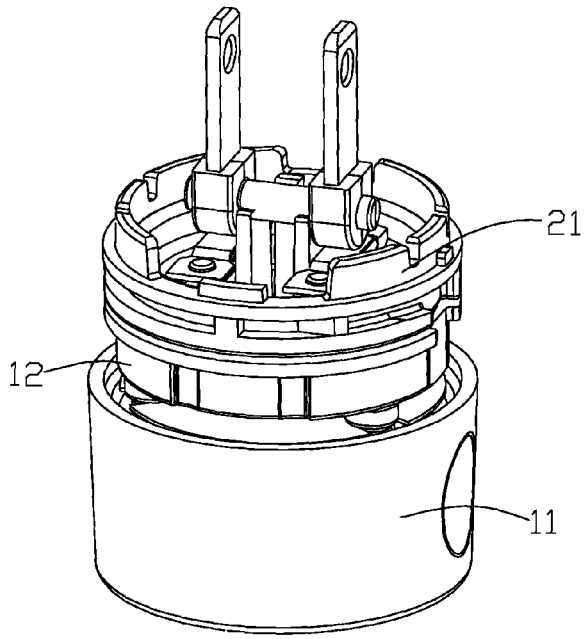
FIG. 6 is a combination perspective view of the adapter body and the plug.

Please refer to FIG. 2, FIG. 5 and FIG. 6. The rotation locking collar 30 is detachably sleeved onto the plug receiving base 12 and the support base 21. In this embodiment, the locking collar 30 may have two tab members 31 on the inner top edge thereof, wherein each tab member 31 is adapted to engage with the walls of one elongated engagement groove 214. In one embodiment of the present invention, the locking collar 30 may have two engagement blocks 32 on the inner side thereof adapted to engage with the two engagement grooves 125 on the circular peripheral surface of the plug receiving base 12 and be restrained by the flange 126. In one embodiment of the present invention, the locking collar 30 may have a circular separation rib 34 formed on a substantial middle of the inner side thereof for dividing the inner side into an upper groove 33 and a lower groove 35, wherein the two engagement blocks 32 may be formed in the lower groove 35.

Please refer to FIGS. 1~6 for comprehensive understandings for the assembly of the present invention. First, the locking collar 30 can be sleeved onto the plug receiving base 12 by its two tab members 31 passing through the two guiding grooves 124. Next, the support base 21 of the plug is received into the recess of the plug receiving base 12 with the two engagement grooves 216 engaging with the two engagement blocks 123, and the two tab members 31 enter the two groove inlets 215, respectively. Besides, the flange 126 of the plug receiving base 12 and the circular step rib 213 of the support base 21 can be positioned and engaged within the inner upper groove 33 of the locking collar 30.

Then, by rotating the locking collar 30, the two tab members 31 are allowed to rotate horizontally into and engage with the two elongated engagement grooves 214, respectively, so as to lock the plug. Additionally, the two engagement blocks 32 on the inner side of the locking collar 30 engage with the two engagement grooves 125 on the circular peripheral surface of the plug receiving base 12 and are restrained by the flange 126, so as to secure the locking collar 30.

As disclosed in the present invention, the replaceable plug can be locked so as to prevent the withdrawal thereof from the adapter body. Therefore, it avoids the accidental withdrawal of the plug from the adapter body, so as to prohibit the poor electrical connection.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A power adapter assembly, comprising:

an adapter body comprising a cylindrical casing and a circular plug receiving base fixed on top of the cylindrical casing, the plug receiving base having a recess on the top thereof and a circular peripheral surface, the recess having a first engagement block on the side wall thereof, the circular peripheral surface having a flange with an indentation on the top edge thereof, and a guiding groove formed from the indentation and extending downward to the bottom edge thereof;

a replaceable plug detachably mounted onto the plug receiving base and comprising a cylindrical support base comprising an upper portion and a lower portion sized to fit into the recess of the plug receiving base, the upper portion having an elongated engagement groove along its peripheral surface with one end extending to the bottom edge thereof and alignable with the guiding groove, the lower portion having a first engagement groove adapted to engage with the first engagement block; and a rotation locking collar detachably sleeved onto the plug receiving base and the support base, wherein the locking collar has a tab member on the inner top edge thereof adapted to enter the guiding groove and said one end of the elongated engagement groove, wherein the tab member is further allowed to rotate into and engage with the elongated engagement groove by rotation of the locking collar.

2. The power adapter assembly of claim 1, wherein the circular peripheral surface of the plug receiving base has a second engagement groove formed below the flange and extending downward to the bottom edge thereof, the locking collar has a second engagement block on the inner side thereof adapted to engage with the second engagement groove and be restrained by the flange.

3. The power adapter assembly of claim 2, wherein the locking collar has a circular separation rib formed on a substantial middle of the inner side thereof for dividing the inner side into an upper groove and a lower groove, the support base has a circular step rib projecting radially along the bottom edge of the upper portion except where said one end of the elongated engagement groove is located, the flange and the circular step rib are positioned and engaged within the upper groove.

4. The power adapter assembly of claim 3, wherein the second engagement block is formed in the lower groove.

* * * * *